US010221001B2

(12) United States Patent
Zancan et al.

(10) Patent No.: US 10,221,001 B2
(45) Date of Patent: Mar. 5, 2019

(54) CONTAINER WITH PRESSURE VARIATION COMPENSATION

(71) Applicant: S.I.P.A. SOCIETA' INDUSTRIALIZZAZIONE PROGETTAZIONE E AUTOMAZIONE S.P.A., Vittorio Veneto (IT)

(72) Inventors: Benedetta Zancan, Treviso (IT); David Gaiotti, Susegana (IT); Giada Peruzzo, Villorba (IT); Dino Enrico Zanette, Godega di Sant'Urbano (IT); Laurent Sigler, Boust (FR); Matteo Zoppas, Conegliano (IT)

(73) Assignee: S.I.P.A. SOCIETA' INDUSTRIALIZZAZIONE PROGETTAZIONE E AUTOMAZIONE S.P.A., Vittorio Veneto (IT)

( * ) Notice: Subject to any disclaimer, the term of this patent is extended or adjusted under 35 U.S.C. 154(b) by 0 days.

(21) Appl. No.: 15/500,323

(22) PCT Filed: Jul. 30, 2015

(86) PCT No.: PCT/EP2015/067513
§ 371 (c)(1),
(2) Date: Jan. 30, 2017

(87) PCT Pub. No.: WO2016/016372
PCT Pub. Date: Feb. 4, 2016

(65) Prior Publication Data

US 2017/0217659 A1 Aug. 3, 2017

(30) Foreign Application Priority Data

Jul. 30, 2014 (IT) ..... RM2014A0427

(51) Int. Cl.
*B65D 79/00* (2006.01)
*B65D 1/02* (2006.01)

(52) U.S. Cl.
CPC ..... *B65D 79/005* (2013.01); *B65D 1/0246* (2013.01); *B65D 1/0261* (2013.01); *B65D 1/0292* (2013.01)

(58) Field of Classification Search
CPC ..... B65D 79/00–79/02; B65D 1/00–1/0238; B65D 1/0246; B65D 1/0253; B65D 1/61;
(Continued)

(56) References Cited

U.S. PATENT DOCUMENTS 9,617,029 B2 * 4/2017 Lane ..... B29C 49/0005
2012/0248059 A1 * 10/2012 Saito ..... B65D 1/0276 215/371

(Continued)

FOREIGN PATENT DOCUMENTS

EP 2319771 * 11/2011

*Primary Examiner* — Kareen K Thomas
(74) *Attorney, Agent, or Firm* — Abelman, Frayne & Schwab

(57) ABSTRACT

A bottle made of PET which can be filled with a hot, warm or cold liquid has a neck, a body and a closed bottom. The body has a peripheral groove for pressure relief capable of collapsing in a controlled manner under the bias of an externally applied vertical axial load. The structure of the groove is such that after collapsing the bottle will not be able to resume its original shape unless it is subjected to the application of another external force of sufficient strength in reverse direction with respect to the force which was applied to obtain the collapsed shape.

10 Claims, 7 Drawing Sheets

(58) Field of Classification Search
CPC .. B65D 1/0269; B65D 1/0276; B65D 1/0284; B65D 1/0292
USPC ..... 215/40–55, 379–385
See application file for complete search history.

(56) References Cited

U.S. PATENT DOCUMENTS

2013/0026128 A1* 1/2013 Beck ..... B65D 1/44 215/382
2013/0213925 A1* 8/2013 Forsthovel ..... B65D 1/0261 215/370
2014/0183156 A1* 7/2014 Hanan ..... B65D 1/0223 215/382
2014/0183202 A1* 7/2014 Hanan ..... B65D 1/0284 220/669
2014/0238951 A1* 8/2014 Forsthovel ..... B65D 1/0261 215/382
2015/0129536 A1* 5/2015 Moulin ..... B65D 1/0223 215/382
2015/0144587 A1* 5/2015 Hanan ..... B65D 1/0284 215/377
2015/0298848 A1* 10/2015 Hermel ..... B65D 1/0284 215/373
2015/0314907 A1* 11/2015 Kira ..... B65D 1/0223 215/383
2015/0321826 A1* 11/2015 Bouffand ..... B67D 3/0035 222/1
2015/0329234 A1* 11/2015 Hanan ..... B65D 1/0223 215/375
2016/0137331 A1* 5/2016 Hanan ..... B65D 1/0246 215/44
2016/0144992 A1* 5/2016 Hermel ..... B65D 1/0284 215/375

* cited by examiner

CONTAINER WITH PRESSURE VARIATION COMPENSATION

CROSS REFERENCE TO RELATED APPLICATIONS

This application is a national phase of PCT application No. PCT/EP2015/067513, filed Jul. 30, 2015, which claims priority to IT patent application No. RM2014A000427, filed Jul. 30, 2014, all of which are incorporated herein by reference thereto.

FIELD OF THE INVENTION

The present invention relates to a collapsible plastic container for packing non-carbonated liquids.

STATE OF THE ART

Liquids are usually packed in primary containers, which can be made of glass, aluminum, multilayer cartons or synthetic or natural polymeric material, with a marked tendency to use plastic containers preferably made of polyethylene terephthalate (PET). PET containers have the advantage of being very light and having an original design, and can be made in large quantities by means of a process of stretch-blow molding. This process involves the formation of PET preforms by injection molding, the preform thus obtained is subsequently first heated and then stretched longitudinally and inflated in an appropriate molding cavity so as to make it assume the shape of the desired container. PET is a relatively expensive material, thus the development of containers which are as light as possible is very important. The need to limit the amount of PET leads to the development of containers with structures which are able to adequately compensate for the fragility caused by the thinness of the walls. For this lightening procedure to be successful, i.e. for a given performance to continue to be maintained, functional mechanisms which are not required for the thicker containers, must be introduced. Indeed, with thinner walls the plastic container is more sensitive to temperature variations of the contained liquid. The problem of designing containers which can withstand said temperature variations is more apparent in beverage containers filled by a process called Hot Fill, which is a sterilization technique to fill containers with beverages, such as juices, teas, sports and isotonic drinks, etc. In said process, the temperature of the liquid at the time of filling is around 85° C., or a temperature sufficient for complete sterilization. Without a proper design, the container could collapse or become irreversibly deformed because of the thin walls. For example, the weight of a 500 ml bottle for juice or tea, which is commonly hot filled, is in the 22 g-28 g range, and special functional mechanisms need to be added for weights lower than this, i.e. below 20 g. This type of container normally has a base and a cylindrical body, a shoulder and a neck. After filling, the bottle is closed while the liquid is still warmer than ambient temperature and the cooling of the liquid creates a drop in the internal pressure which can cause a shrinking of the bottle. The cooling causes a slight decrease in the volume of the liquid along with a reduction of the gaseous phase saturation. Indeed, by having a reduction in the number of gaseous molecules, the gaseous phase occupies a slightly greater volume and therefore creates a reduction in pressure with respect to the initial pressure. The bottle must thus be designed with such a structural configuration to resist such a shrinkage. Generally, in order to obtain a greater strength and to avoid the collapsing of the bottle, vacuum balancing panels are introduced along the walls of the cylindrical body. The function of these panels is to flex towards the inside of the bottle, thus accompanying the decrease of volume caused by the cooling of the liquid. This decrease, however, creates strain points at the edges of the panels, which must be offset by generally vertical ribs placed between one panel and the other, and by other horizontal ribs above and below the panel to reinforce the structure, and thus the stiffness of the bottle. The consequence of all this is an increase of manufacturing costs. There is therefore the need to improve the stability of these bottles, in all cases without having to resort to using a greater amount of plastic material.

Another technique used for collapsible containers involves an accordion or bellows type design of structure which allows for a vertical collapse of the container. However, this technique is unsuitable for hot filling because of the inherent instability along the vertical axis under compressive load. In the case of warm or cold filling, where there is no volume variation, or at least the variation is minor and may occur during the shelf life of the filled container, a slight counter pressure, e.g. by using nitrogen, is also necessary to make the container stronger.

EP2319771 discloses a container which can be compressed by virtue of two peripheral grooves, i.e. a rigid and a collapsible peripheral groove. The collapsible groove, as well as the parts to which it is connected, have a rather complex shape, i.e. with a number of alternated curved and straight sides. Therefore, when a high number of such containers is to be produced, and in particular during the blow moulding stage, such features are difficult to reproduce for every container. It is to be noted that the collapsible groove is provided with a curved and a straight side, and that the inventors did not take into account the angle of aperture of the groove as a design parameter. In addition, the collapsible groove is provided relatively far away from the neck. Therefore, disadvantageously, due to the hydrostatic pressure, the force required to compress the container is high, and such container is prone to take its original shape when, for example, the temperature of the liquid raises due to environmental conditions.

It is therefore felt the need to introduce functional mechanisms to improve hot fill bottle stability without having to resort to using of a greater amount of plastic material or in the case of cold fill to avoid the addition of nitrogen.

SUMMARY OF THE INVENTION

It is thus an object of the present invention to provide a lightened thermoplastic container, in particular a PET bottle, in which the pressure of the filled container can be increased without using nitrogen for warm and cold filling or the internal volume of which can be reduced in a controllable manner for hot filling without resorting to using reinforced vacuum panels or accordion type structures. It is worth noting that after a container according to the invention has been filled with a hot liquid and successively sealed, or capped, it is subject to lateral shrinking because of the drop of internal pressure caused by the cooling of the liquid inside the container. Herein, "lateral shrinking" means an inward deformation of the container walls, along a direction perpendicular to its longitudinal axis Z, with respect to an original width of the container before the hot filling. The container of the invention can be compressed axially along the longitudinal axis Z of the container applying an external compression force that will act upon a functional mechanism being part of the container resulting in a reduction of the internal volume and of the height of the container. It is worth noting that said axial compression force is greater than a force resulting from atmospheric pressure. The application of the external axial compression force results in the recovery of the original width of the container. The original width cannot be recovered by a force resulting from atmospheric pressure. In other words, the container of the invention, after it has been filled with a hot liquid and sealed, can recover its original shape only by means of a substantially and exclusively axial compression force, since it is not provided with other different means to recover the original shape. Furthermore, the volume reduction of the container can be permanent, the return to the original shape necessitating the application of another external force, i.e. a traction force. The present invention therefore achieves the object described above by means of a collapsible thermoplastic container for liquids, suitable for hot filling, warm filling and cold filling processes of non-carbonated liquids, defining a longitudinal axis Z, and comprising, according to claim 1:

a body, a neck, provided with an opening at a first side of the body, a base, defining a base plane at a second side of the body opposite to the first side, the body having two substantially frustoconical or frustopyramidal portions having their smaller bases opposed to each other, so as to constitute a peripheral groove, between the neck and the middle of the container along the longitudinal axis (Z), having a V-shaped profile on its projection on a first plane coplanar with the longitudinal axis (Z), the V-shaped profile having an apex pointing towards the longitudinal axis (Z); a proximal straight side, proximal to the neck, having a first slope of first angle $\alpha_2$ with respect to a second plane perpendicular to the longitudinal axis (Z), and a first length ($d_1$); and a distal straight side, distal to the neck, having a second slope of second angle ($\alpha_1$)with respect to said second plane, and a second length ($d_2$), wherein the second length ($d_2$) is smaller than the first length $d_1$, and wherein the first angle $\alpha_2$ is greater than the second angle ($\alpha_1$), whereby the proximal straight side comes into contact with the distal straight side, thus reducing the internal volume of the container, only when a compression force greater than a force resulting from atmospheric pressure is applied along the longitudinal axis (Z), also after the compression force is released.

To achieve the effects of the invention, it is an advantageous to provide two straight sides which can contact each other. It is also advantageous to provide a curved portion adjacent to a respective straight side. Furthermore, it is advantageous to take into account the slopes of both the straight sides, and therefore also the angle of aperture of the groove, as a design parameter.

The proximal and distal straight sides can be knurled.

According to an embodiment, the body has a part proximal to the neck and a part distal from the neck which are connected to the proximal and distal straight sides by a first curved portion and a second curved portion, respectively. Preferably, the part proximal to the neck is directly connected, i.e. adjacent, to the proximal straight side, and the part distal to the neck is directly connected to the distal straight side. More preferably, there is not an inflection point between each curved portion and the respective straight side. Therefore, unnecessary additional grooves or additional straight or curved portions, which could be difficult to reproduce for every container when produced in mass, are avoided.

Preferably, when the container is not compressed, a tangent to the first curved portion, for example the tangent which is parallel to the longitudinal axis Z, intersects the second curved portion or the distal straight side.

The second curved portion can be corrugated in order to facilitate the collapsing of the peripheral groove starting from the distal side. For example, at least one peripheral annular groove can be provided; such annular groove preferably defines a circle on its projection on a plane perpendicular to the longitudinal axis of the container, the circle having its center on the longitudinal axis. The number of such annular grooves can be variable, for example two, three, four or more of such annular grooves, which are spaced apart from each other, can be provided.

According to one advantageous embodiment, the peripheral groove is located at a distance h measured from the base plane of the container, where (h) is comprised between (hTot/2) and ⅘*hTot), where (hTot) is the total length of the container along the longitudinal axis (Z) before the collapse. Such position of the peripheral groove is particularly advantageous since the groove is relatively close to the "head space" of the container, i.e. the space which is not filled with liquid. Therefore, since a lower hydrostatic force must be overcome, the force required to compress the container is lower as compared to a groove positioned in a lower position. This also helps to keep the container in a compressed state during the life cycle of the container. For instance, if the liquid temperature should rise, the hydrostatic pressure would tend to force the container in its original conformation, and when the position of the groove is higher, i.e. proximal to the neck, such disadvantageous hydrostatic pressure is lower. Preferably, the peripheral groove is arranged in a curved portion, also known as "shoulder", between the neck and the cylindrical body of the container.

The peripheral groove can be segmented in order to achieve a more stable position. According to one embodiment, the apex is an internal rib which is shaped as an arc of a circle having a radius $R_i$ comprised between 0 and 3 mm on its projection on a plane coplanar with the longitudinal axis Z.

According to a further embodiment the apex is an internal rib shaped as a straight segment, preferably but not exclusively parallel to the longitudinal axis Z, having a length $h_i$ comprised between 0 and 3 mm on its projection on a plane coplanar with the longitudinal axis Z. Advantageously, according to such embodiments, the internal rib is relatively small sized.

The internal rib can be shaped as a wavy circle on its projection on a plane perpendicular to the longitudinal axis Z.

Furthermore, the container can be made of PET.

Advantageously, in the case of cold or warm filling at temperatures slightly below the glass transition temperature $T_g$, the container is subjected to an external force after filling and capping which increases the internal pressure, compensates for possible volume variations and increases the top load of the container.

BRIEF DESCRIPTION OF THE FIGURES

Further characteristics and advantages of the invention will become more apparent in light of the detailed description of preferred, but not exclusive embodiments of a PET bottle of the type collapsible for hot filling comprising a functional vacuum compensation mechanism, illustrated by way of non-limiting example with the aid of the following figures.

The same numbers and the same letters of reference in the figures identify the same elements or components.

DESCRIPTION IN DETAIL OF A PREFERRED EMBODIMENT OF THE INVENTION

The present invention relates to a container, in particular a bottle, made of a synthetic resin, such as PET, having a functional mechanism to avoid uncontrolled shrinkage effects due to pressure variations.

In order to compensate the internal pressure variation in the bottle, a functional mechanism has been invented so that by applying an axial external force, i.e. a force acting along the longitudinal axis Z of the bottle, the internal volume and the height of the bottle are reduced in a controlled manner. This reduction in volume, due to the decrease in height of the bottle, creates an increase in the internal pressure which can compensate any pressure reduction that may occur because of the temperature or volume variation of the contained liquid in the various phases of the life cycle of the packaged product. If there is no pressure reduction, as previously described, then the bottle can withstand higher vertical top loads due to this reduction in volume. The functional mechanism of the present invention can be applied to bottles having different cross sections transversal to the longitudinal axis Z of the bottle, such as cylindrical, square, octagonal, polygonal cross sections, etc. By way of non-limiting example, the containers according to the invention can have a volume ranging from 500 ml to 1000 ml. For instance, a container of the invention can have a volume of 500 ml and a weight of 18-22 g, preferably 18-20 g, e.g. 19 g. In the present document, part of the description of the following embodiments will be carried out referring to the projection on a plane, in particular on a plane coplanar with the longitudinal axis Z.

Figure 1:
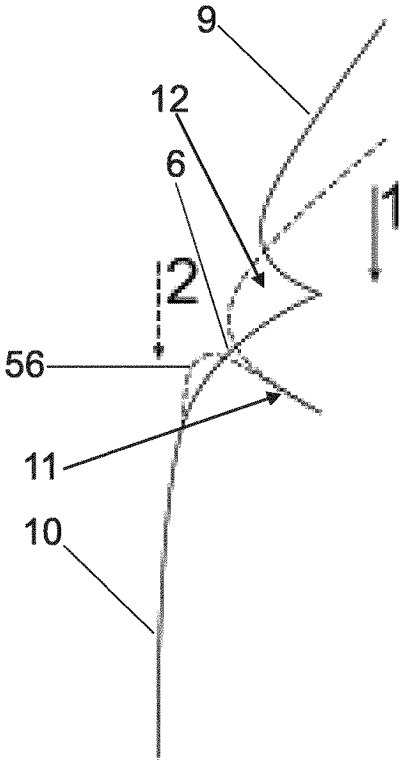
FIG. 1 shows the cross section profile of a detail of a bottle, according to a first embodiment of the invention, showing the collapsing sequence by applying an external compressive force.
Figure 2:
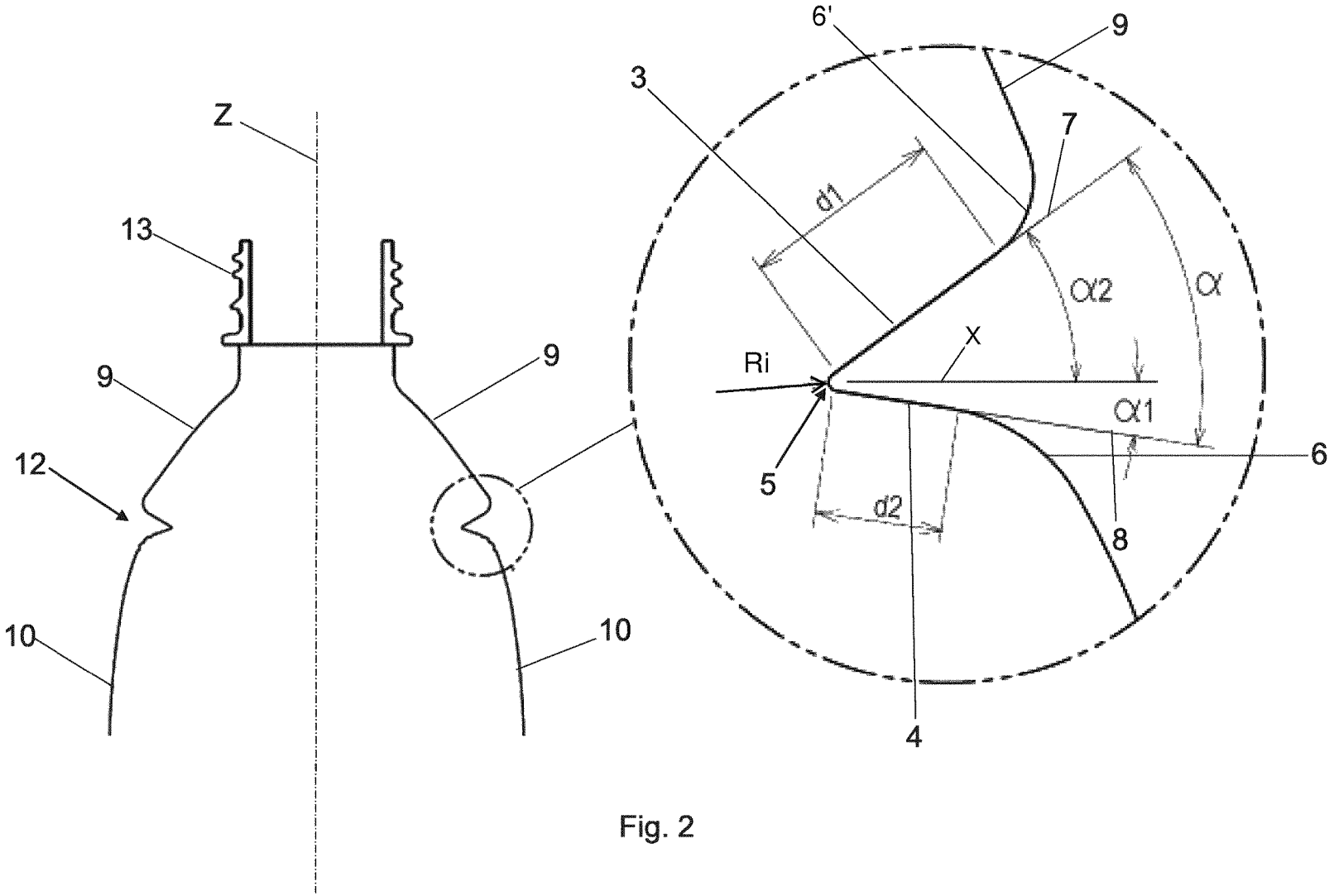
FIG. 2 shows a longitudinal section profile and an enlarged detail of part of a bottle according to FIG. 1.

Referring to FIG. 1 and FIG. 2, according to a first embodiment, the bottle of the invention defines a longitudinal axis Z, and comprises a body having a neck 13 with an opening at one side, and a base, not shown, which closes the bottle and defines a base plane, opposite to the neck 13. The body has a part 9 proximal to the neck 13 and a part 10 distal from the neck 13. Between the proximal 9 and distal 10 parts, there are two substantially frustoconical portions of the body, having their smaller base opposed to each other. In other words, the larger base of the frustoconical portion, which is proximal to the neck 13, points towards the proximal part 9, and the larger base of the frustoconical portion, which is distal from the neck 13, points towards the distal part 10. In this manner, a peripheral groove 12 is formed, which in this embodiment is a circumferential groove, having a V-shaped profile on its projection on a plane coplanar with the longitudinal axis Z and its apex 5 pointing towards the longitudinal axis Z. Preferably, the peripheral groove is located at the "shoulder" of the container, i.e. in the curved portion of the bottle which is proximal to its neck. The V-shaped profile has two straight sides, i.e. a first straight side 3 proximal to the neck 13, and a second straight side 4 distal from the neck 13. Therefore, the peripheral groove 12 is a gap having a length along the longitudinal axis Z which decreases from the external side of the bottle to the apex 5. In this embodiment, the apex is an internal rib 5, defining a ring, which is shaped as an arc of circle having a radius $R_i$ comprised between 0 and 3 mm on its projection on a plane coplanar with the longitudinal axis Z.

The proximal side 3 has a slope 7 of angle $\alpha_2$ with a plane X perpendicular to the longitudinal axis Z, and the distal side 4 has a slope 8 of angle $\alpha_1$ with the plane X. For example, the plane X is the plane containing the medium point of the arc of circle of the internal rib 5.

The angle of aperture of the peripheral groove is indicated by a and is determined by the following equation:

$$\alpha=\alpha_1+\alpha_2$$

where $\alpha_2>\alpha_1$

As mentioned, the proximal 3 and distal 4 sides are straight; the proximal side has a length $d_1$, the distal side has a length $d_2$, and $d_2$ is smaller than $d_1$. Lengths $d_1$ and $d_2$ are the actual lengths of the straight sides, i.e. those indicated in FIG. 2. The depth of the peripheral groove, along a direction perpendicular to the longitudinal axis Z, is substantially determined by $d_2$ and $d_1$.

The proximal part 9 and the distal part 10 are connected, preferably directly, to a respective frustoconical portion of the body by a curved portion, which in FIG. 2 is shown as an arc of circle. The curved portion between the distal part 10 and its respective frustoconical portion is indicated by reference numeral 6. The curved portion between the proximal part 9 and its respective frustoconical portion is indicated by reference numeral 6'. Preferably, the tangent, parallel to the longitudinal axis Z, to the curved portion 6' intersects the curved portion 6 or the distal straight side 4.

The functional mechanism provided by the invention is shown in FIG. 1, which shows the collapsing of the bottle when an external compression force is applied centrally, for example at the neck 13, along the longitudinal axis Z. The original position, or conformation, of the bottle is indicated by reference numeral 1, solid line, and the final position, or conformation, is indicated by reference numeral 2, dashed line. By applying such a compression force, the peripheral groove 12 changes position and shape. In particular, in the final position 2, the peripheral groove 12 is collapsed on itself. The action of the functional mechanism is that with the application of an external force of about 90-130 N, preferably in function of the shape of inner rib 5, the proximal side 3 and the distal side 4 unite, i.e. contact each other, as shown in FIG. 1 with the reference 11. The application of an external compression force guarantees that the collapsing of the peripheral groove 12 is controlled.

When the external force is progressively applied to the bottle, the collapsing sequence starts at the distal side 4 which flexes towards the base of the bottle inverting its original slope starting from an inversion point, with the inner rib 5 moving at a faster speed and reaching, at the end of the movement, the lowest allowed position, i.e. being at a height along the longitudinal axis Z which is more distant from the neck 13, with respect to its original position before the collapse. The proximal side 3 moves down, almost maintaining its shape and slope. Pushed by the proximal side 3, the curved portion 6 radially moves away from the longitudinal axis Z while reducing its curvature radius, with respect to its original position, and changing its shape in this way, as shown in FIG. 1 by reference numeral 56, in this way helping in giving more stability and rigidity to the bottle. The structure of the peripheral groove 12 and the applied force result in a snap action which provokes the sudden collapse of the groove gap which closes on itself, as shown by the final position 2, dashed line, in FIG. 1. Such a final position 2 is in stable equilibrium and only an external traction force can let the bottle assume its original position 1. The closing of the groove is achieved smoothly by the external force as a continuous downward movement, i.e. towards the base of the container, which goes from the original position 1 towards position 2, until the sudden collapse occurs. This collapse is irreversible and remains also after eliminating the axial load, i.e. the compression force. When the external compression force is applied, the groove collapses and disrupts the so-called "memory" of the polymer, which does not allow the groove to return to the original form without the intervention of another external force in the opposite direction, i.e. a traction force. It is obvious that if there is a pressure reduction within the bottle, the force which must be applied to re-obtain the original shape will be greater.

It is worth noting that it is advantageously possible to achieve an effective snap mechanism by virtue of straight sides adjacent to curved portions, as in the compressible bottle of the invention, e.g. the straight side 4 adjacent to the curved portion 6. Indeed, the curved portion 6, which in the conformation assumed in the final position 2 is indicated by reference numeral 56 (FIG. 1), exerts such a force on the united straight sides, reference numeral 11 in FIG. 1, that only a traction force can take the bottle back to its original position 1. Furthermore, because they are straight, these united straight sides 11, can withstand the force exerted by the curved portion indicated by reference numeral 56. It is also advantageous to have the curved portion 6' adjacent to the straight portion 3.

The mechanism described above is substantially the same for all the embodiments and their variants of the invention.

Figure 3:
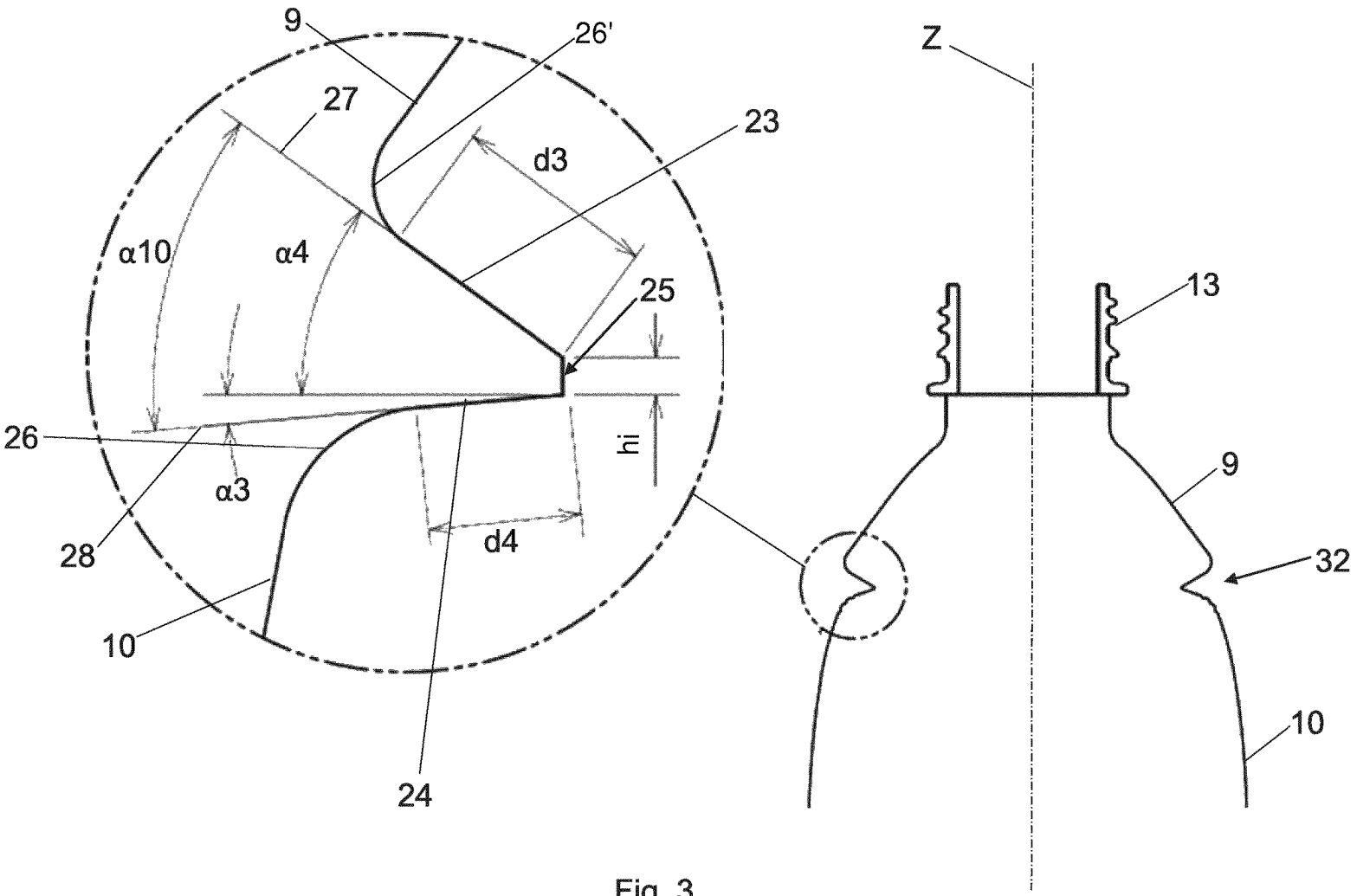
FIG. 3 shows a longitudinal section profile and an enlarged detail of part of a bottle according to a second embodiment of the invention.

Referring to FIG. 3, according to a second embodiment of the invention, the bottle defines a longitudinal axis Z, and comprises a body having a neck 13 with an opening at one side, and a base, not shown, which closes the bottle and defines a base plane, opposite to the neck 13. The body has a part 9 proximal to the neck 13 and a part 10 distal from the neck 13. Between the proximal 9 and distal 10 parts, there are two substantially frustoconical portions of the body, having their smaller base opposed to each other. In other words, the larger base of the frustoconical portion, which is proximal to the neck 13, points towards the proximal part 9, and the larger base of the frustoconical portion, which is distal from the neck 13, points towards the distal part 10. In this manner, a peripheral groove 32 is formed, which in this embodiment is a circumferential groove, having on its projection on a plane coplanar with the longitudinal axis Z a V-shaped profile, its apex 25 pointing towards the longitudinal axis Z. Preferably, the peripheral groove is located at the "shoulder" of the container, i.e. in the curved portion of the bottle which is proximal to its neck. The V-shaped profile has two straight sides, i.e. a first straight side 23 proximal to the neck 13, and a second straight side 24 distal from the neck 13. Therefore, the peripheral groove 32 is a gap having a length along the longitudinal axis Z which decreases from the external side of the bottle to the apex 25. In this embodiment, the apex is an internal rib 25, defining a ring, which is shaped as a straight segment on its projection on a plane coplanar with the longitudinal axis (Z) of length $h_i$ comprised between 0 and 3 mm, conferring a cross section shape which resembles part of a trapezoid to the peripheral groove 32.

The proximal side 23 has a slope 27 of angle $\alpha_4$ with a plane X perpendicular to the longitudinal axis Z, and the distal side 24 has a slope 28 of angle $\alpha_3$ with the plane X.

The angle of aperture of the peripheral groove is indicated by ala and is determined by the following equation:

$$\alpha_{10}=\alpha_3+\alpha_4$$

where $\alpha_4>\alpha_3$

As mentioned, the proximal 23 and distal 24 sides are straight: the proximal side has a length $d_3$ and the distal side has a length $d_4$, and $d_4$ is smaller than $d_3$. Lengths $d_3$ and $d_4$ are the actual lengths of the straight sides, i.e. those indicated in FIG. 3. The depth of the peripheral groove, along a direction perpendicular to the longitudinal axis Z, is substantially determined by $d_4$ and $d_3$.

The proximal part 9 and the distal part 10 are connected, preferably directly, to a respective frustoconical portion of the body, by a curved portion, which in FIG. 3 is shown as an arc of circle. The curved portion between the distal part 10 and its respective frustoconical portion is indicated by reference numeral 26. The curved portion between the proximal part 9 and its respective frustoconical portion is indicated by reference numeral 26'. Preferably, the tangent, parallel to the longitudinal axis Z, to the curved portion 26' intersects the curved portion 26 or the distal straight side 4.

The collapsing mechanism is substantially the same as in the first embodiment of the invention.

Preferably, both in the first and second described embodiment, the groove is located between the neck and the maximum diameter of the bottle and is given by the expression:

$$h_{Tot}/2<h<4/5h_{Tot}$$

where h indicates the height of the position of the peripheral groove measured from the base plane of the bottle and $h_{Tot}$ indicates the original total height of the bottle before the collapsing of the bottle because of the applied external force.

Figure 4:
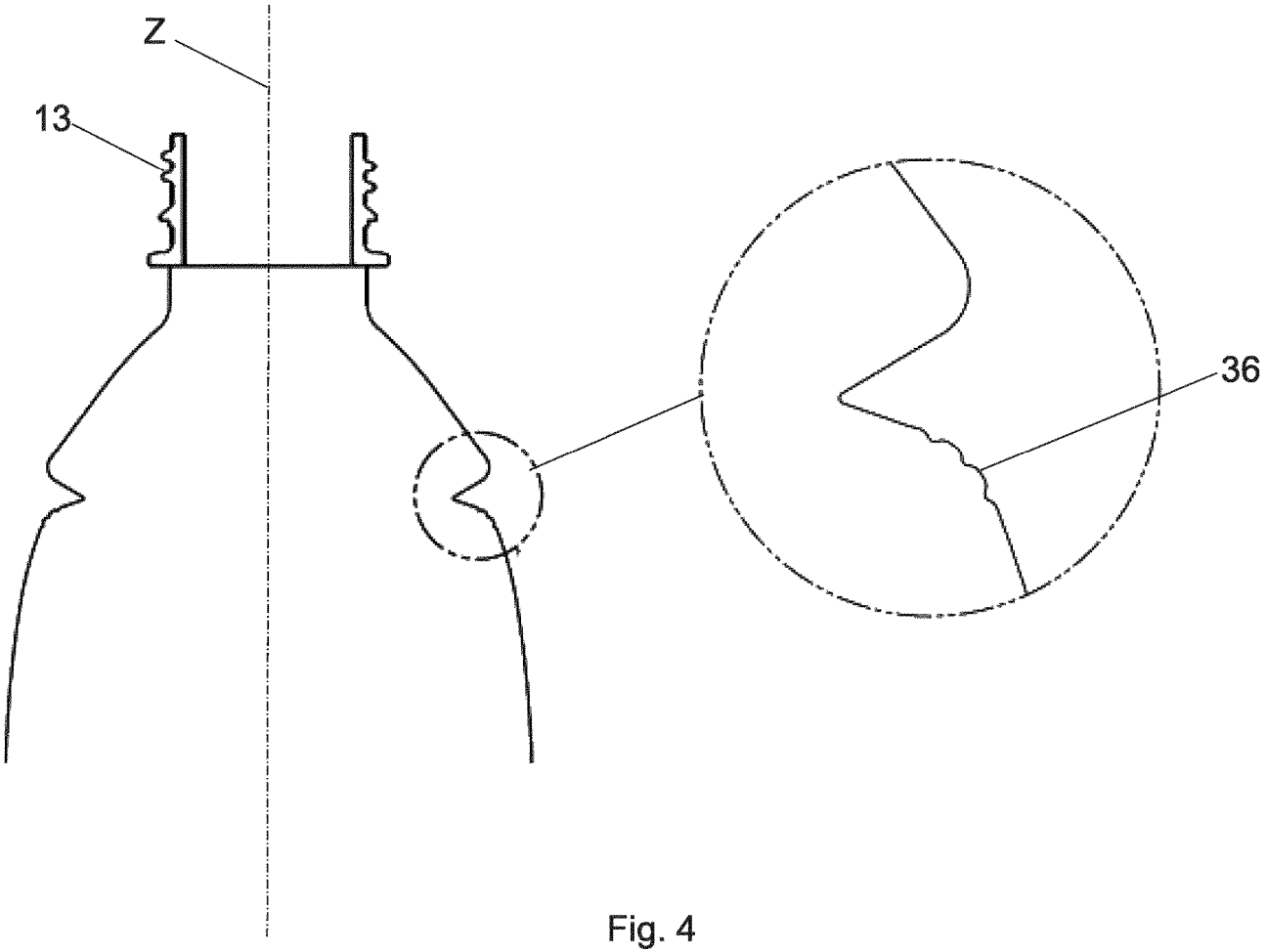
FIG. 4 shows a longitudinal section profile and an enlarged detail of part of a bottle according to a first variant of the embodiments of the invention.

Referring to FIG. 4, according to a variant of the first and second embodiment, the curved portion 36 connecting the distal part 10 to the frustoconical portion, is corrugated, in order to facilitate the collapsing of the peripheral groove starting from the distal side. In FIG. 4 there are shown three peripheral annular grooves, spaced apart from each other, each defining a circle on their projections on a plane perpendicular to the longitudinal axis Z.

Figure 5:
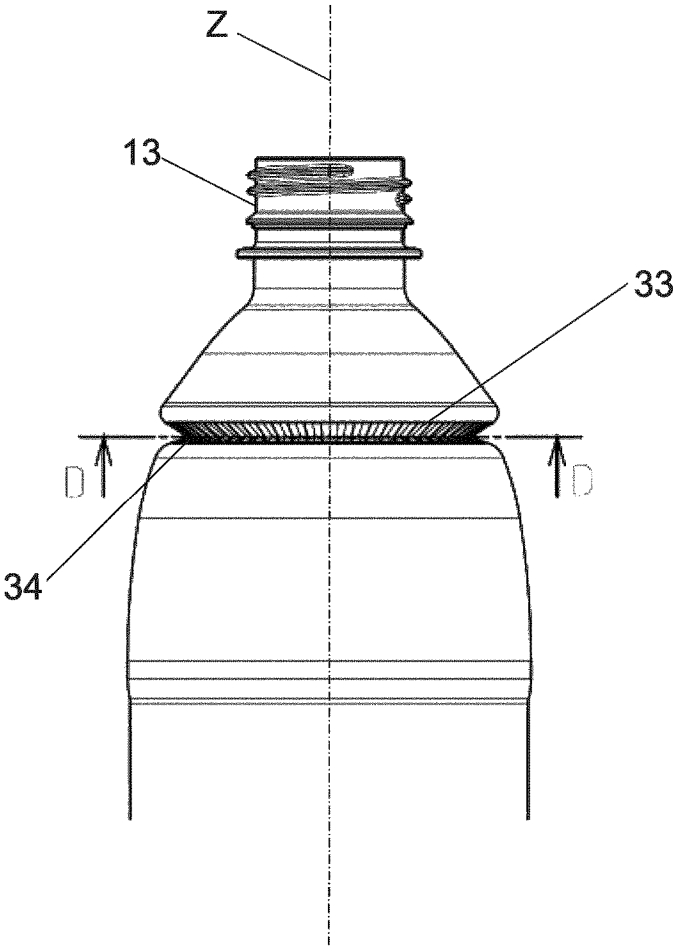
FIG. 5 shows a longitudinal section of part of a bottle and transversal section according to a second variant of the embodiments of the invention.
Figure 5:
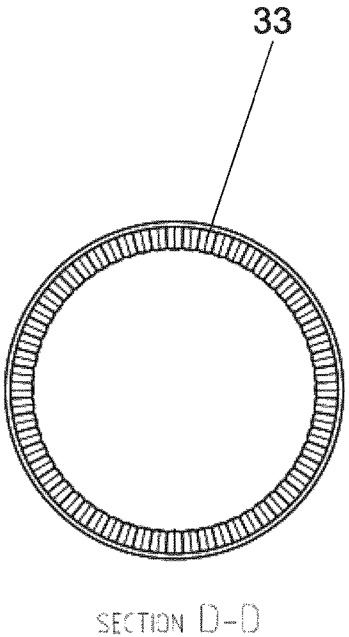

Referring to FIG. 5, according to a variant of the first and second embodiment, the proximal side 33 and the distal side 34 are knurled. For example, a plurality of protruding ribs can be provided, so that the surface of the proximal and straight side is substantially ondulated. The ribs of the proximal and of the distal side are straight and can mesh together.

Figure 6:
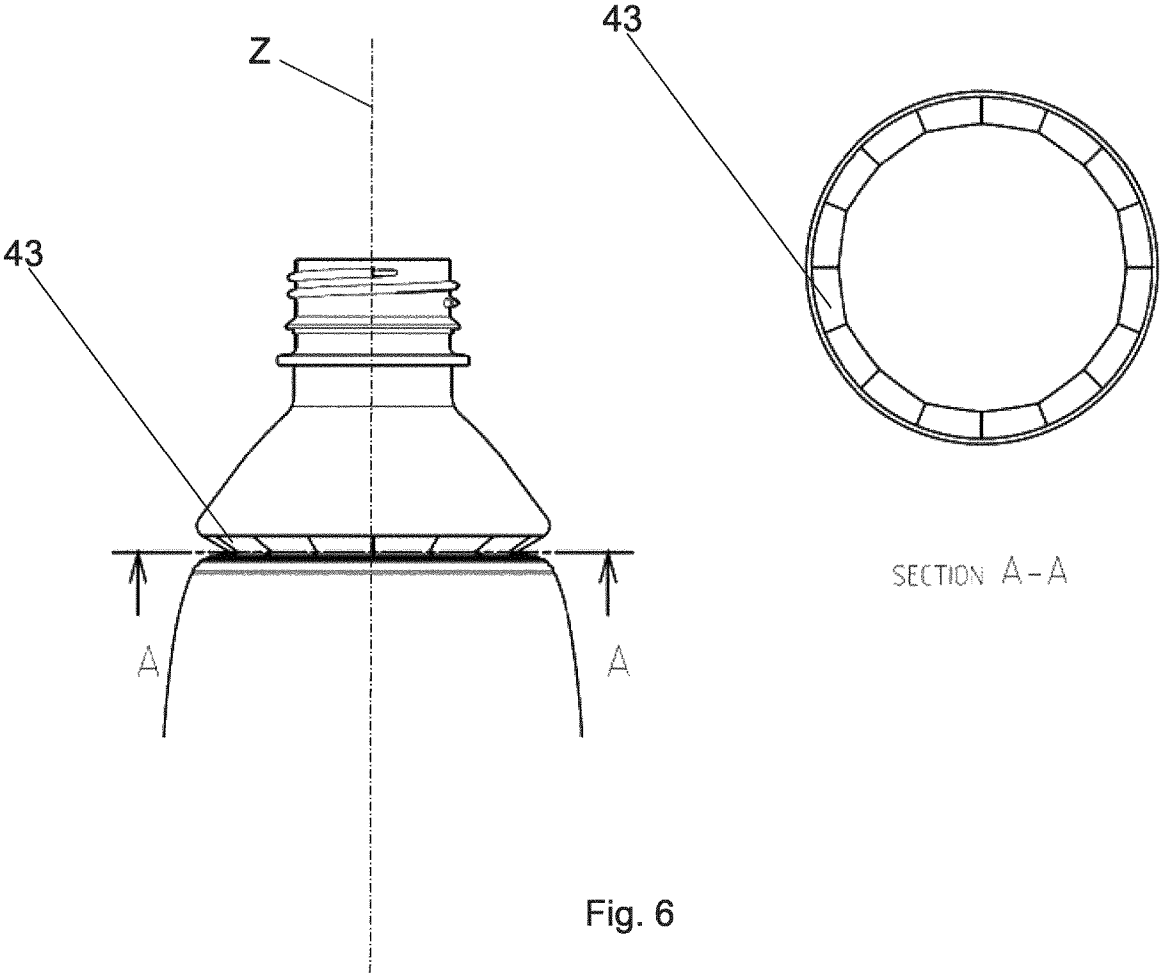
FIG. 6 shows a longitudinal section of part of a bottle and transversal section according to a third variant of the embodiments of the invention.

Referring to FIG. 6, according to a variant of the first and second embodiment, the proximal side 43 and the distal side are segmented. For example, a plurality of ribs can be provided, so that a plurality of substantially rectangular shaped zones are defined on the surface of the proximal and straight sides.

Figure 7:
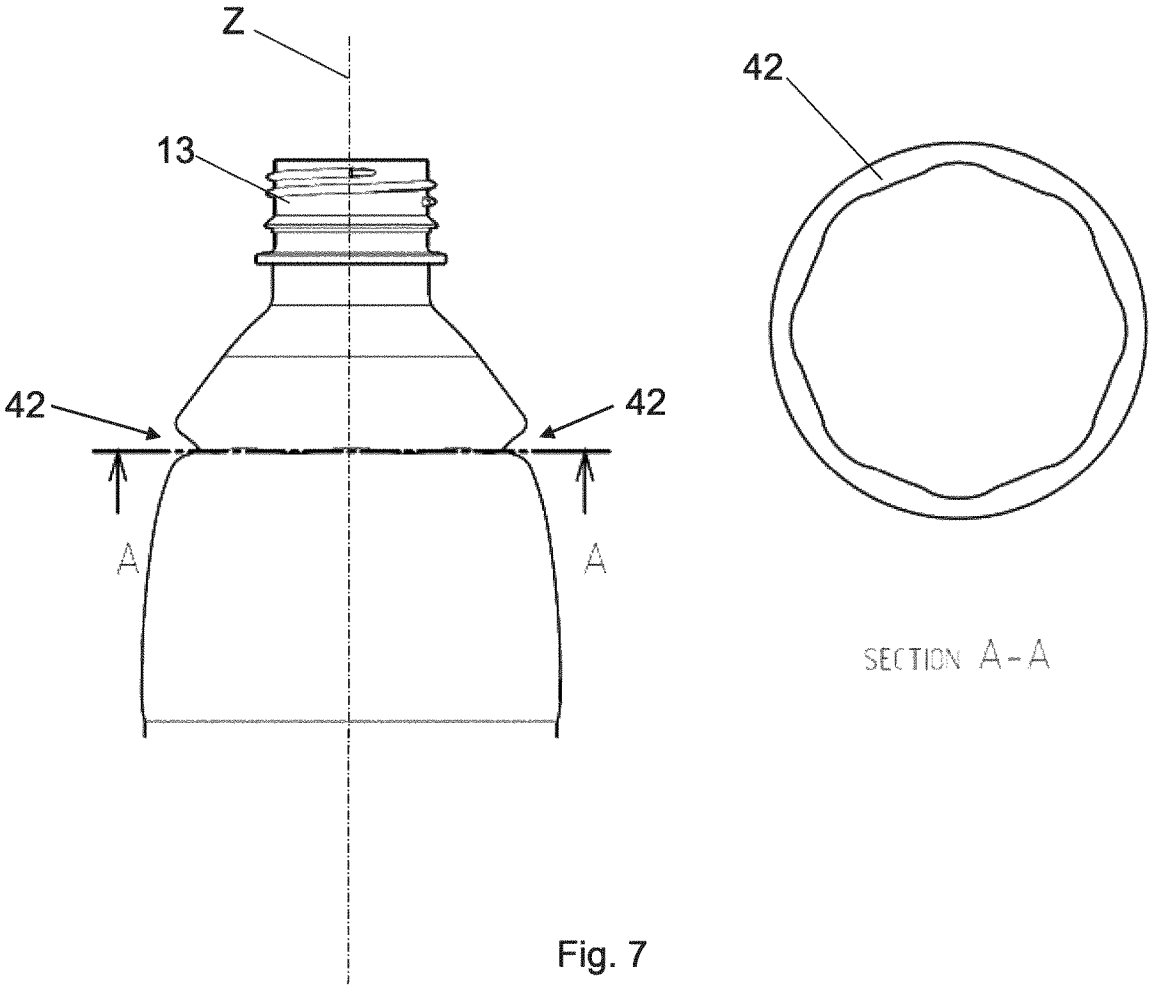
FIG. 7 shows a longitudinal section of part of a bottle and transversal section according to a fourth variant of the embodiments of the invention.

Referring to FIG. 7, according to a variant of the first and second embodiment, the internal rib 42 of the peripheral groove, on its projection on a plane perpendicular to the longitudinal axis Z, is shaped as a wavy circle.

These different configurations, shown in FIGS. 5-7, help to confer a rigidity which necessitates an external force to achieve the collapsing of the bottle at the peripheral groove. Furthermore, these different configurations and the shape of the groove are also as a function of the type of bottle, which can be circular or square or polygonal.

The invention is described with particular reference to a cylindrical bottle, but it is worth noting that other bottle embodiments are possible without departing from the essence of the invention. As mentioned, it is apparent that the invention can be applied to square or polygonal bottle and that the groove can have different shapes.

The invention claimed is:

1. A collapsible thermoplastic container for liquids, suitable for hot filling, warm filling or cold filling processes of non-carbonated liquids, defining a longitudinal axis (Z), and comprising:

a body, a neck, provided with an opening at a first side of the body, a base, defining a base plane at a second side of the body opposite to the first side, the body having two substantially frustoconical or frustopyramidal portions having their smaller bases opposed to each other, so as to constitute a peripheral groove, between the neck and the middle of the container along the longitudinal axis (Z), having a V-shaped profile on its projection on a first plane coplanar with the longitudinal axis (Z), the V-shaped profile having an apex pointing towards the longitudinal axis (Z); a proximal straight side, proximal to the neck, having a first slope of first angle $\alpha_2$ with respect to a second plane perpendicular to the longitudinal axis (Z), and a first length ($d_1$); and a distal straight side, distal to the neck, having a second slope of second angle ($\alpha_1$) with respect to said second plane, and a second length ($d_2$), wherein the second length ($d_2$) is smaller than the first length $d_1$, and wherein the first angle $\alpha_2$ is greater than the second angle ($\alpha_1$), whereby the proximal straight side comes into contact with the distal straight side, thus reducing the internal volume of the container, only when a compression force greater than a force resulting from atmospheric pressure is applied along the longitudinal axis (Z), also after the compression force is released.

2. The collapsible thermoplastic container according to claim 1, wherein said proximal and distal straight sides are knurled.

3. The collapsible thermoplastic container according to claim 1, wherein the body has a first part proximal to the neck and a second part distal from the neck which are connected to the proximal and distal straight sides by a first curved portion and a second curved portion, respectively.

4. The collapsible thermoplastic container according to claim 3, wherein said second curved portion is corrugated.

5. The collapsible thermoplastic container according to claim 3, wherein the first curved portion is directly connected, without inflection points, to the proximal straight side and the second curved portion is directly connected, without inflection points, to the distal straight side.

6. The collapsible thermoplastic container according to claim 1, wherein said peripheral groove is located at a distance (h) measured from the base plane of the container, where the distance (h) is comprised between ($h_{Tot}2$) and ($4/5h_{Tot}$), where ($h_{Tot}$) is the length of the container along the longitudinal axis (Z) before the collapse.

7. The collapsible thermoplastic container according to claim 1, wherein said peripheral groove is segmented.

8. The collapsible thermoplastic container according to claim 1, wherein the apex is an internal rib which is shaped as an arc of a circle having a radius ($R_i$) comprised between 0 and 3 mm on its projection on said first plane coplanar with the longitudinal axis (Z).

9. The collapsible thermoplastic container according to claim 1, wherein the apex is an internal rib shaped as a straight segment having a length ($h_i$) comprised between 0 and 3 mm on its projection on said first plane coplanar with the longitudinal axis (Z).

10. The collapsible thermoplastic container according to claim 8, wherein said internal rib is shaped as a wavy circle on its projection on a plane perpendicular to the longitudinal axis (Z).

* * * * *